US007281504B2

(12) United States Patent
Fujita et al.

(10) Patent No.: US 7,281,504 B2
(45) Date of Patent: Oct. 16, 2007

(54) VALVE TRAIN DEVICE FOR ENGINE

(75) Inventors: Hideo Fujita, Shizuoka-ken (JP); Koichi Hatamura, Hiroshima (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/263,528

(22) Filed: Oct. 31, 2005

(65) Prior Publication Data

US 2006/0107915 A1 May 25, 2006

Related U.S. Application Data

(63) Continuation of application No. PCT/JP04/06428, filed on May 6, 2004.

(30) Foreign Application Priority Data

May 1, 2003 (JP) ..... 2003-126257
Aug. 28, 2003 (JP) ..... 2003-304931

(51) Int. Cl.
*F01L 1/34* (2006.01)

(52) U.S. Cl. ..... 123/90.16; 123/90.2; 123/90.44; 74/569

(58) Field of Classification Search ..... 123/90.16, 123/90.27, 90.31, 90.39, 90.44, 90.2, 90.41; 74/559, 567, 569
See application file for complete search history.

(56) References Cited

U.S. PATENT DOCUMENTS 4,572,118 A 2/1986 Baguena (Continued)

FOREIGN PATENT DOCUMENTS

DE 19708484 9/1998

(Continued)

OTHER PUBLICATIONS

International Search Report for Application No. PCT/JP2004/006428.

(Continued)

*Primary Examiner*—Ching Chang
(74) *Attorney, Agent, or Firm*—Knobbe, Martens, Olson & Bear, LLP.

(57) ABSTRACT

A valve train device for an engine is configured to pivot a rocker arm supported on a rocker arm support shaft to drive a valve which opens and closes a valve opening formed in a combustion chamber. The device comprises a valve drive device and a swing member pivotally supported on a swing member support shaft and driven to pivot about the swing member support shaft by the valve drive device. A control arm is disposed between a swing cam surface formed on the swing member and a rocker-side surface formed on the rocker arm. The control arm is configured for transferring motion of the swing cam surface to the rocker-side surface. A displacement mechanism is provided for displacing a contact point between the control arm and the swing cam surface and a contact point between the control arm and the rocker-side surface. The rocker-side surface has an arcuate shape which arcs about a center of pivoting motion of the swing member and wherein the rocker-side surface or an extension of the rocker-side surface about said center of pivoting motion of the swing member passes in substantially near a center of swing of the rocker arm.

(Continued)

22 Claims, 5 Drawing Sheets

U.S. PATENT DOCUMENTS

| | | | |
|---|---|---|---|
| 4,714,057 | A | 12/1987 | Wichart |
| 5,018,487 | A | 5/1991 | Shinkai |
| 5,189,998 | A | 3/1993 | Hara |
| 5,373,818 | A | 12/1994 | Unger |
| 5,601,056 | A | 2/1997 | Kuhn et al. |
| 6,135,075 | A | 10/2000 | Boertje et al. |
| 6,422,187 | B2 | 7/2002 | Fischer et al. |
| 6,425,357 | B2 | 7/2002 | Shimizu et al. |
| 6,481,399 | B1 | 11/2002 | Morrn |
| 6,659,053 | B1 | 12/2003 | Cecur |
| 6,907,852 | B2 | 6/2005 | Schleusener et al. |
| 7,069,890 | B2 | 7/2006 | Fujita et al. |
| 7,096,835 | B2 | 8/2006 | Fujita et al. |
| 2001/0052329 | A1 | 12/2001 | Himsel |
| 2006/0075982 | A1 | 4/2006 | Fujita et al. |
| 2006/0102120 | A1 | 5/2006 | Fujita et al. |
| 2006/0207532 | A1 | 9/2006 | Fujita et al. |
| 2006/0207533 | A1 | 9/2006 | Fujita et al. |
| 2006/0243233 | A1 | 11/2006 | Fujita et al. |

FOREIGN PATENT DOCUMENTS

| | | |
|---|---|---|
| DE | 10123186 | 11/2002 |
| JP | 63-309707 | 12/1988 |
| JP | 02-241916 | 9/1990 |
| JP | 06-017626 | 1/1994 |
| JP | 06-93816 | 4/1994 |
| JP | 06-093816 | 4/1994 |
| JP | 06-272525 | 9/1994 |
| JP | 06-307219 | 11/1994 |
| JP | 07-063023 | 3/1995 |
| JP | 07-133709 | 5/1995 |
| JP | 07-193216 | 11/1995 |
| JP | 09-268907 | 10/1997 |
| JP | 11-36833 | 2/1999 |
| JP | 2000-213320 | 8/2000 |
| JP | 2001-263015 | 9/2001 |
| JP | 2002-371816 | 12/2002 |
| JP | 2003-106123 | 4/2003 |
| JP | 2003-148116 | 5/2003 |
| JP | 2003-201814 | 7/2003 |
| JP | 2003-239713 | 8/2003 |
| WO | WO 2002/92972 A1 | 11/2002 |

OTHER PUBLICATIONS

U.S. Appl. No. 9864/1987, filed Jul. 1988.

U.S. Appl. No. 99707-1986, filed Jan. 1988.

Anontaphan, Thitiphol. A study of a mechanical continuous variable rocker arm (VRA), SAE technical paper series 2003-01-0022, 2003 SAE World Congress Detroit, Michigan, Mar. 3-6, 2003.

VALVE TRAIN DEVICE FOR ENGINE

PRIORITY INFORMATION

This application is continuation of PCT Application No. PCT/JP2004/006428, filed on May 6, 2004, which claims priority under 35 U.S.C. § 119 to Japanese Patent Application No. 2003-304931, filed on Aug. 28, 2003 and Japanese Patent Application No. 2003-126257, filed on May 1, 2003, the entire contents of these applications are expressly incorporated by reference herein.

BACKGROUND OF THE INVENTION

1. Field of the Invention

This invention relates to a valve train device for an engine and, more particularly, to a valve train device which can continuously change valve opening duration and/or the amount of valve lift.

2. Description of the Related Art

It is known in the art how to provide engines with valve train devices that are capable of continuously changing intake valve opening duration and/or the amount of valve lift. An example of such a valve train device comprises a camshaft, which drives an intake valve to open and close through a rocker arm. This device is arranged in such a way that a swing member is pivoted by the camshaft. A control arm is interposed between a swing cam surface of the swing member and a rocker-side depressed surface of the rocker arm. The valve opening duration and the amount of valve lift is continuously varied by changing a position of the control arm that comes into contact with the swing cam surface and a position of the control arm that comes into contact with the rocker-side depressed surface (See e.g., JP-A-Sho 59-500002).

SUMMARY OF THE INVENTION

Using the aforementioned constitution, in which the position of the control arm to come into contact with the rocker-side depressed surface is changed, in the conventional type of valve train device may result in a problem depending on where the rocker-side depressed surface is disposed. For example, there may be a low transfer efficiency of force, applied from the swing cam surface to the control arm, and transferred to the rocker arm and therefore to the valve.

An object of an embodiment of the present invention is to address the situations with the prior art described above and provide a valve train device for an engine which can enhance transfer efficiency of the force, applied to the control arm, and transferred to the rocker arm and therefore to the valve.

Therefore, one embodiment of the present invention comprises a train device for an engine that is configured to pivot a rocker arm supported on a rocker arm support shaft to drive a valve which opens and closes a valve opening formed in a combustion chamber. The device comprises a valve drive device and a swing member pivotally supported on a swing member support shaft and driven to pivot about the swing member support shaft by the valve drive device. A control arm is disposed between a swing cam surface formed on the swing member and a rocker-side surface formed on the rocker arm. The control arm is configured for transferring motion of the swing cam surface to the rocker-side surface. A displacement mechanism is provided for displacing a contact point between the control arm and the swing cam surface and a contact point between the control arm and the rocker-side surface. The rocker-side surface has an arcuate shape which arcs about a center of pivoting motion of the swing member and wherein the rocker-side surface or an extension of the rocker-side surface about said center of pivoting motion of the swing member passes in substantially near a center of swing of the rocker arm.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

A general architecture that implements various features of specific embodiments of the invention will now be described with reference to the drawings. The drawings and the associated descriptions are provided to illustrate embodiments of the invention and not to limit the scope of the invention.

DETAILED DESCRIPTION OF THE PREFERRED EMBODIMENTS

An embodiment of the present invention will be described hereinafter with reference to the attached drawings.

Figure 1:
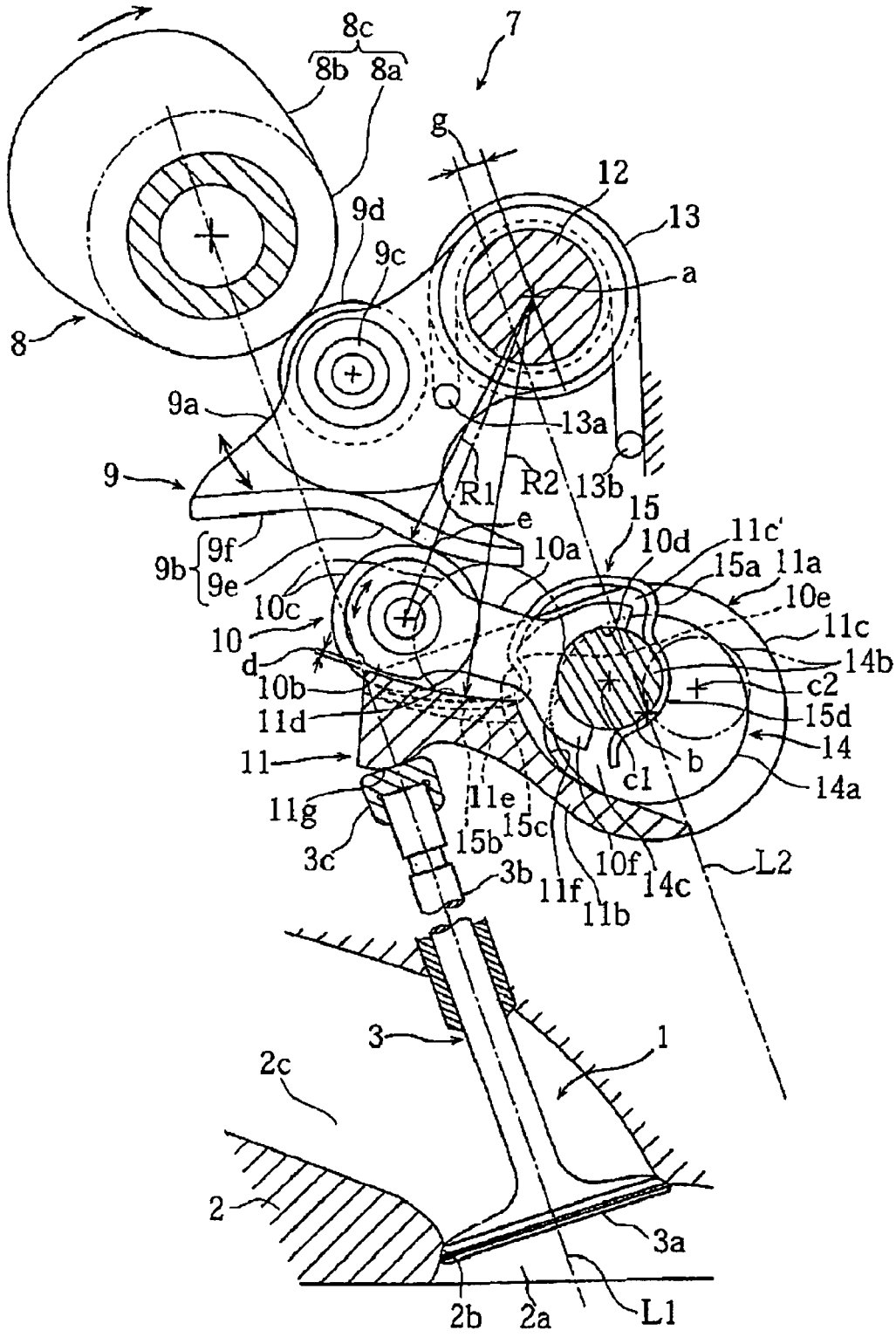
FIG. 1 is a sectional side view of a valve train device for an engine according to a first embodiment of the present invention.
Figure 2:
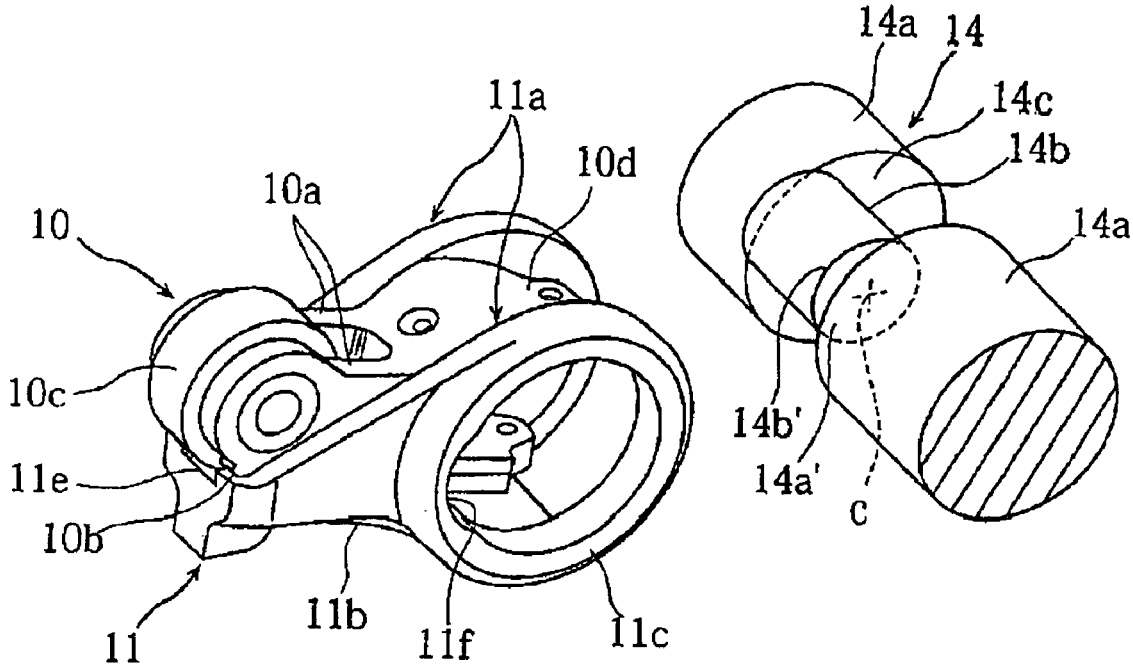
FIG. 2 is a perspective view of a control arm, rocker arm and rocker shaft of the first embodiment.
Figure 3:
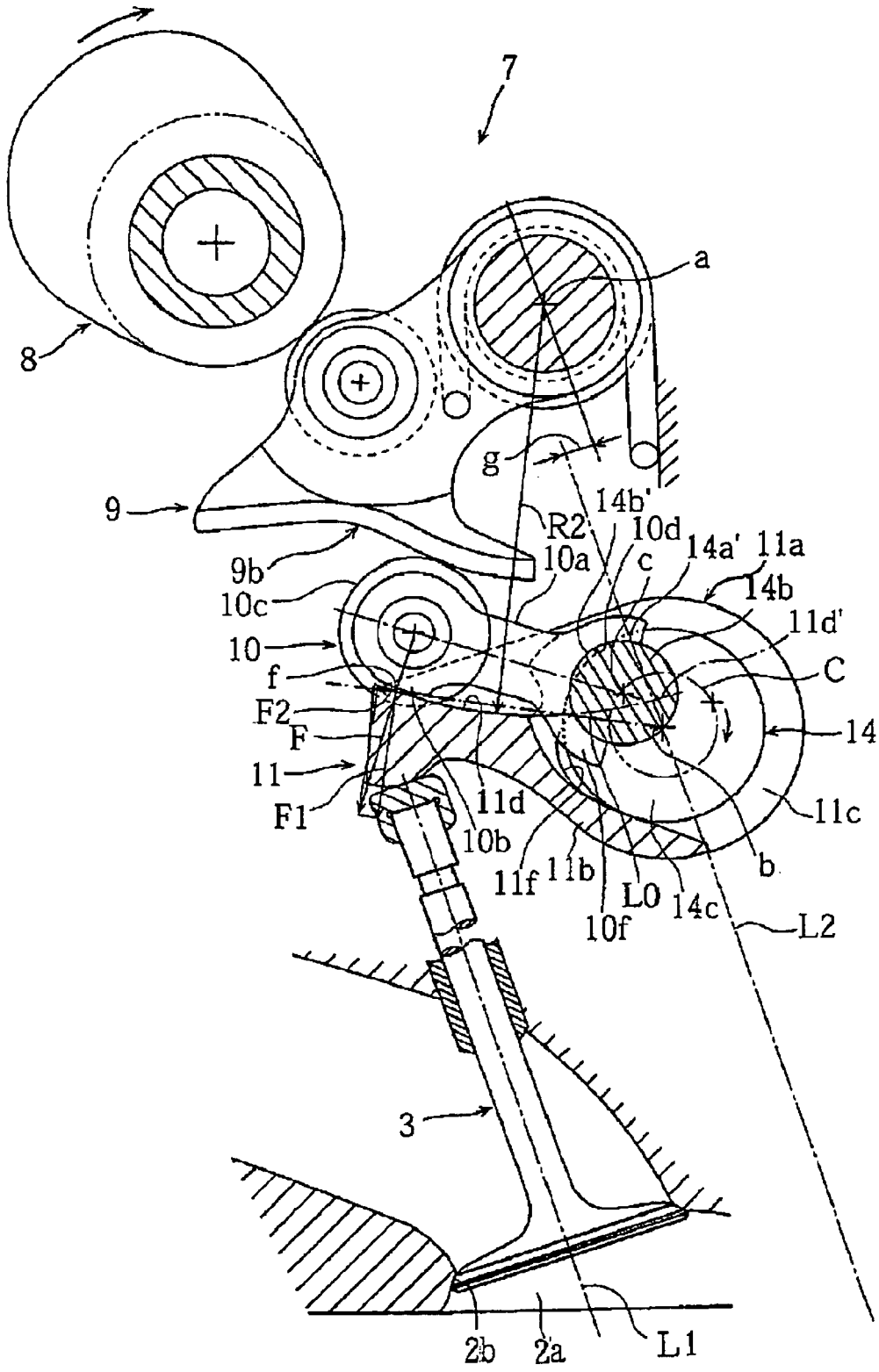
FIG. 3 is a sectional side view for describing the functions of an embodiment of the invention.

FIGS. 1–3 are describe a first embodiment of the invention. FIG. 1 is a sectional side view of a valve train device according to this embodiment of the invention. FIG. 2 is a perspective view of core parts of the valve train device. FIG. 3 is a view for describing transfer efficiency of a force F in this embodiment of the invention.

In FIG. 1, reference numeral 1 denotes an valve device for opening and closing an valve opening formed in a combustion chamber. An engine can be provided with two intake and exhaust valve devices. However, in FIG. 1, only a portion at an intake valve device is shown. A combustion recess 2*a* is provided on the mating face of a cylinder head 2 of the engine with the cylinder body. The combustion recess 2*a* forms a top ceiling of a combustion chamber. The combustion recess 2*a* includes left and right intake valve openings 2*b*. Each intake valve opening 2*b* is merged with an intake port 2*c* and led to an external connection opening of an engine wall. Each intake valve opening 2*b* is opened and closed through a valve head 3*a* of an intake valve 3. The intake valve 3 is constantly urged with a valve spring or biasing member (not shown) in closing direction.

In the embodiments described below, reference will be made to the intake valve 3 and intake valve device 1. However, it should be appreciated that certain features and aspects of these embodiments may also be applied to an exhaust device and exhaust valve. It should also be appreciated that various features, aspects and advantages of the present invent may be used with engines having more than one intake valve and/or exhaust valve, and any of a variety of configurations including a variety of numbers of cylinders and cylinder arrangements (V, W, opposing, etc.).

A valve train device 7 is disposed above the intake valve 3. The valve train device 7 is configured such that: (i) an intake camshaft 8 which serves as swing member drive device causes a swing member 9 to swing or pivot, (ii) the swing member 9 causes a rocker arm 11 to swing or pivot through a control arm 10, and (iii) the swing of the rocker arm 11 causes the intake valve 3 to proceed and retract in the axial direction, and thus the intake valve opening 2*b* is opened and closed.

Causing the control arm 10 to proceed and retract can continuously change a contact point between the control arm 10 and the swing member 9 and a contact point between the control arm 10 and the rocker arm 11, thereby continuously changing the opening duration of the intake valve 3 and the amount of valve lift.

The intake camshaft 8 may be arranged in parallel with a crankshaft (not shown). The intake camshaft may be supported to be rotatable and immobile in a direction perpendicular to the crankshaft and in the axial direction through a cam journal portion formed on the cylinder head 2 and a cam cap provided on an upper mating face of the journal portion. In the illustrated embodiment, the intake camshaft 8 is formed with a single cam nose 8*c* common to the left and right intake valves, including a base circle portion 8*a* having a specified diameter, and a lift portion 8*b* having a specified cam profile. Each cylinder is provided with a single cam nose.

The swing member 9 has a pair of left and right swing arm portions 9*a*, 9*a*, a swing cam surface 9*b*, a roller shaft 9*c*, and a swing roller 9*d*. The pair of swing arm portions 9*a*, 9*a* is supported for free swinging movement by a swing shaft 12 arranged in parallel with the intake camshaft 8 so as to be immobilized in the direction perpendicular to the swing shaft and in the axial direction. The swing cam surface 9*b* is formed to connect the front (lower) ends of the swing arm portions 9*a*. The roller shaft 9*c* is arranged in parallel with the swing shaft 12 and in the midsection between the left and right swing arm portions 9*a*, 9*a* to pass therethrough. The swing roller 9*d* is rotatably supported on the roller shaft 9*c*. The swing roller 9*d* is constantly in rotational contact with the cam nose 8*c*.

Base (upper) portions of the swing arm portions 9*a* is fitted to and supported with the swing shaft 12 for free swinging movement. The swing shaft 12 is provided with a pair of left and right balance springs 13 (e.g., coil springs). Each balance spring 13 has a first end 13*a* retained between the swing shaft 12 of the swing arm portion 9*a* and the roller shaft 9*c*. A other end 13*b* of each balance spring is retained by the cylinder head 2. The balance spring 13 urges the swing member 9 such that the swing roller 9*d* of the swing member 9 comes into contact with the cam nose 8*c* of the intake camshaft 8, thereby preventing the swing roller 9*d* from moving away from the cam nose 8*c* at the high engine speed. This avoids or reduces abnormal behavior of the swing member 9.

The swing cam surface 9*b* has a base circle portion 9*e* and a lift portion 9*f* formed together in a curved manner to have a connected surface and a generally plate-like shape. The swing member 9 is provided so that the base circle portion 9*e* is positioned nearer to a rocker shaft 14 and the lift portion 9*f* is positioned opposite the rocker shaft 14. The base circle portion 9*e* has an arcuate shape of a radius R1 centered on the axis of the swing shaft 12 as the center of swing (a). Thus, while the base circle portion 9*e* depresses the roller 10*c*, the intake valve 3 is placed at a fully closed position and not lifted even if a swing angle of the swing member 9 increases.

Meanwhile, the lift portion 9*f* lifts the intake valve 3 greatly as the lift portion 8*b* of the intake camshaft 8 at the portion close to the top depresses the swing roller 9*d*, that is, as the swing angle of the swing member 9 increases. In this embodiment, the lift portion 9*f* includes a ramp zone which gives a constant speed, an acceleration zone which gives a varied speed, and a lift zone which gives generally a constant speed.

The rocker shaft 14 includes a large-diameter portion 14*a* and an eccentric pin 14*b* having a smaller diameter than the diameter for the large-diameter portion. In the illustrated embodiment, the eccentric pin 14*b* is provided on a mid-section of the large-diameter portion, while being offset from an axial center (b) of the rocker shaft 14 toward the outer side in the radial direction. The large-diameter portion 14*a* is rotatably supported with the cylinder head 2. The eccentric pin 14*b* has an axial center (c) positioned such that part of the outer surface 14*b*' protrudes outward in the radial direction from an outer surface 14*a*' of the larger-diameter portion 14*a*. To the rocker shaft 14 is connected a rocker shaft driving mechanism (not shown) for controlling an angular position of the rocker shaft 14 according to an engine load (throttle opening) and engine speed.

The rocker arm 11 is formed with left and right rocker arm portions 11*a*, 11*a*, a rocker coupling portion 11*b*, and ring-shaped bearing portions 11*c*, 11*c*. Lower-half portions on the distal end side of the left and right rocker arm portions 11*a*, 11*a* are coupled integrally with the locker coupling portion 11*b*. The ring-shaped bearing portions 11*c*, 11*c* are formed integrally with the proximal ends of the left and right rocker arms 11*a*, 11*a*. The bearing portions 11*c*, 11*c* are supported with the large-diameter portions 14*a*, 14*a* of the rocker shaft 14. Part of the bearing portions 11*c* towards the rocker arm portions 11*a* is provided with a clearance recess 11*f* that conforms to the outwardly projecting shape of the eccentric pin 14*b*.

The control arm 10 has a schematic structure in which: a control-side depressing surface 10*b* is formed in an arcuate shape about the center of swing (a) on the lower face of the distal ends of the left and right bifurcated control arm portions 10*a, a*; the roller 10*c* in rotational contact with the swing cam surface 9*b* is pivoted between the distal ends of the control arm portions a, a; and the bifurcated, semi-circular bearing portion 10*d* is formed at the proximal ends of the control arm portions.

Figure 4:
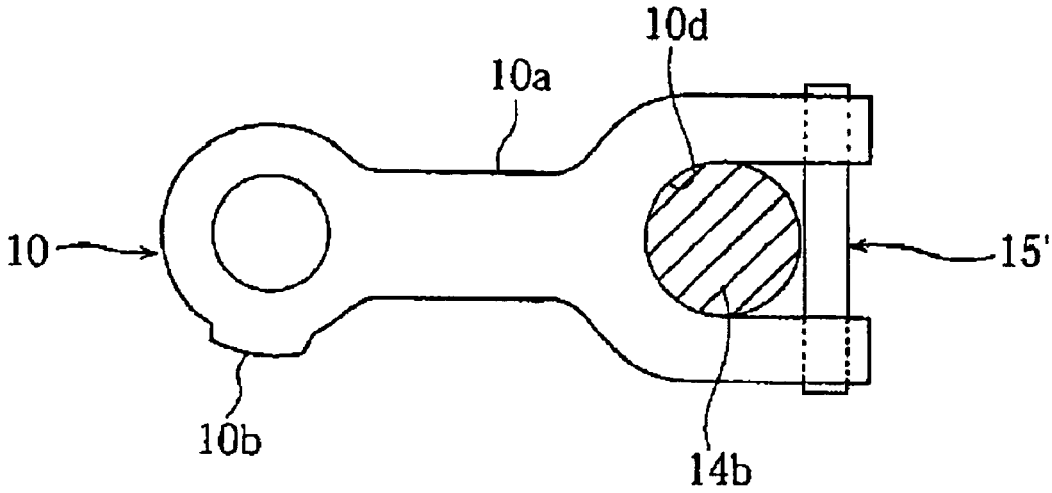
FIG. 4 is a schematic view showing an embodiment of a come-off prevention member of the first embodiment.

On the topside of the rocker coupling portion 11*b* of the rocker arm 11, left and right rocker-side depressed surfaces 11*d*, 11*d* are formed to come into sliding contact with the left and right control-side depressing surfaces 10*b*, 10*b*. The rocker-side depressed surfaces 11*d*, 11*d* are formed in an arcuate shape of a radius R2 about the center of swing (a) of the swing shaft 12. As shown in FIG. 4, An extension line 11*d*' of the rocker-side depressed surface 11*d* is so set as to pass in the vicinity of the center of sing (b) of the rocker arm 11, and more preferably, to pass inside a rotation locus C of the axial center (c) of the eccentric pin 14*b*.

With reference to FIG. 1, the control arm 10 is placed such that it is interposed between the left and right rocker arm portions 11*a*, 11*a* of the rocker arm 11. The semi-circular bearing portion 10*d* is rotatably supported with the eccentric pin 14*b* of the rocker shaft 14. The come-off prevention spring 15 prevents the bearing portion and the eccentric pin from coming off.

In one embodiment, the come-off prevention spring 15 is made of spring steel band member, and has a holding portion 15*a* curved into approximately a C-shape and a depressing portion 15*b* that extends from the front end of the holding portion 15*a* toward the distal end of the rocker arm 11. The come-off prevention spring 15 is designed to retain a curved retaining portion 15*c*, which is formed adjacent to the boarder between the holding portion 15*a* and the depressing portion 15*b*, to a retained portion 10*e* of the control arm 10. The come-off prevention spring 15 is also designed to retain an accurate retaining portion 15*d*, which is formed opposite to the pressing portion 15*b*, to the eccentric pin 14*b*. Thereby, the come-off prevention spring 15 holds the bearing portion 10*d* and the eccentric pin 14*b* together for relative rotation while preventing them from separating from each other.

The distal end of the depressing portion 15*b* of the come-off prevention spring 15 comes into contact with a depressing groove 11*e* with a predetermined amount of spring force, the depressing grove being provided on the topside of the rocker coupling portion 11*b* of the rocker arm 11 and at the center in the axial direction. The depressing groove 11*e* is formed in an arcuate shape about the center of rotation (a) of the swing member 9. In the manner as described, the control arm 10 is urged clockwise as shown in the drawing. The roller 10*c* comes into contact with the swing cam surface 9*b*. A slight gap (d) is created between the rocker-side depressed surface 11*d* and the control-side depressing surface 10*b*.

In the manner as described, a displacement mechanism is constituted such that rotating the rocker shaft 14 allows a contact point (e) between the roller 10*c* and the swing cam surface 9*b* as well as a contact point (f) between the control-side depressing surface 10*b* and the rocker-side depressed surface 11*d* to be displaced.

In the displacement mechanism, displacement of the contact point relative to the rotation angle of the rocker shaft 14 in a high operation range in which the opening duration of the intake valve 3 is long and the amount of the valve lift is large (shown by solid lines in FIG. 1) and in a low operation range in which the opening duration of the intake valve 3 is short and the amount of the valve lift is small (shown by chain double-dashed lines in FIG. 1) is smaller than the displacement of the contact point in a medium operation range in which the opening duration of the intake valve 3 and the amount of the valve lift are medium. In other words, in the high operation range, the axial center of the eccentric pin 14*b* is positioned near the point identified by the reference number c1 in FIG. 1, while near the point identified by reference number c2 in the low operation range. When the eccentric pin 14*b* is adjacent to the points c1 or c2, each displacement of the contact points e and f relative to the rotation angle of the rocker shaft 14 is smaller than that in another operation range. In contrast, in the medium operation range, the axial center of the eccentric pin 14*b* is positioned approximately between c1 and c2. When the eccentric pin 14*b* is adjacent approximately between c1 and c2, each displacement of the contact point e and f relative to the rotation angle of the rocker shaft 14 is larger than those in the other operation ranges.

An axial end surface 10*f* of the bearing portion 10*d* is in sliding contact with an end surface 14*c* of the large-diameter portion 14*a* of the rocker shaft 14, the end surface forming a step from the eccentric pin 14*b*, thereby positioning the control arm 10 in the axial direction. In turn, an inner end surface 11*c*' of the bearing portion 11*c* is in sliding contact with an opposite end surface to the end surface 10*f* of the bearing portion 10*d* of the control arm 10, thereby positioning the rocker arm 11 in the axial direction.

Description will be next made of the operations and effects of this embodiment.

In the valve train device 7 of this embodiment, the rocker shaft driving mechanism controls a rotational angular position of the rocker shaft 14 in accordance with engine operation conditions determined based on the engine speed and load. For example, in a high-speed and high-load operation range, the angular position of the rocker shaft 14 is controlled to position the axial center of the eccentric pin 14 to point c1 as shown by solid lines in FIG. 1. Thus, when the control arm 10 is positioned at the advanced end and the base circle portion 8*a* of the camshaft 8 comes into contact with the roller 9*d*, the contact point e between the roller 10*c* of the control arm 10 and the swing cam surface 9*b* of the swing member 9 is positioned closest to the lift portion 9*f*. This results in maximizing both the opening duration of the intake valve 3 and the amount of valve lift.

In turn, in a low-speed and low-load operation range, the angular position of the rocker shaft 14 is controlled to position the axial center of the eccentric pin 14 to point c2 as shown by chain double-dashed lines in FIG. 1. Thus, the control arm 10 moves to the retracted end, and the contact point e between the roller 10*c* of the control arm 10 and the swing cam surface 9*b* of the swing member 9 is positioned farthest from the lift portion 9*f*. This results in minimizing both the opening duration of the intake valve 3 and the amount of valve lift.

In one embodiment, the rocker-side depressed surface 11*d* is formed such that the extension line 11*d*' thereof passes in the vicinity of the center (b) of swing of the rocker arm 11. In another embodiment, the structure describe herein allows the extension line 11*d*' to pass inside the rotation locus C (see FIG. 3) of the center point (c) of the eccentric pin 14. In the illustrate embodiment, the control arm 10 is also interposed between the left and right rocker arm portions 11*a*, 11*a* of the rocker arm 11, and the rocker-side depressed surface 11*d* is formed on the rocker coupling portion 11*b* for coupling the left and right rocker arm portions 11*a*, 11*a*. This enhances positioning the extension line 11*d*' of the rocker-side depressed surface 11*d* such that it passes in the vicinity of the center (b) of swing of the rocker arm 11.

In a preferred embodiment, "such that the rocker-side depressed surface 11*d* or its extension line 11*d*' passes in the vicinity of a center of swing (b) of the rocker arm 11" means that the rocker-side depressed surface 11*d* is approximated as close as possible to a straight line Lo that connects the center of swing (b) and a point (f) of application of force F transferred from the control arm 10 to the rocker arm 11, thereby transferring the force F with high efficiency as the rotational force of the rocker arm 11.

The rocker-side depressed surface 11*d* is of the illustrated embodiment is therefore formed in such a manner that the extension line 11*d*' thereof passes in the vicinity of the center (b) of swing of the rocker arm 11. Thus, the force F transferred from the swing member 9 to the contact point (f) via the control arm 10 can be efficiently transferred to the rocker arm 11 and therefore to the valve 3. In other words, in this embodiment, since the rocker-side depressed surface 11*d* passes in the vicinity of the center (b) of swing of the rocker arm 11, the rocker-side depressed surface 11*d* generally agrees with the straight line Lo. This increases a first component force F1 of the force F. The first component force F1 being perpendicular to the straight line Lo as a rotational force of the rocker arm 11 and the force F being transferred from the control arm 10 to the rocker arm 11. Thus, the transfer efficiency of the force F from the control arm 10 to the rocker arm 11 enhances.

The center (a) of swing of the swing member 9 is located at a point opposite to a valve shaft line L1 with respect to a straight line L2 parallel to the valve shaft line L1 and passing the axial center (b) of the rocker shaft 14, while being away from the straight line L2 by a distance g. This provides an advantage to the extension line 11*d*' of the rocker-side depressed surface 11*d* to pass in the vicinity of the center (b) of rotation of the rocker arm 11. More specifically, as an angle formed between the direction of the force F applied to the rocker arm 11 and the straight line Lo that connects a point (f) of application of the force F and the center (b) of swing of the rocker arm 11 is closer to the right angle, the transfer efficiency of the force F increases. Since the center (a) of swing of the swing member 9 is located on the side opposite to the valve shaft line L1, the direction of the force F can be easily changed to be close to the direction perpendicular to the straight line Lo.

The eccentric pin 14*b* provided on the midsection of the rocker shaft 14 is adapted to support the bearing portion 10*d* of the control arm portion a for free rotation, and the come-off prevention spring 15 holds the bearing portion 10*d* and the eccentric pin 14*b*. This allows the opening duration of the valve 3 and the amount of valve lift to continuously change by using a very simple structure or solely rotating the rocker shaft 14. This also facilitates work for coupling the control arm 10 and the eccentric pin 14*b*.

In the case of multi-cylinder engine, because uniform valve opening duration and amount of valve lift need be ensured for all cylinders, several control arms 10 within the dimensional tolerance range are prepared to be selected in combination with the rocker shaft 14 in order to uniform the valve opening duration and the amount of valve. Assemble and removal work when such a selective combination is required can be easily carried out.

The depressing portion 15*b* in the illustrated embodiment is integrally formed with the come-off prevention spring 15, the depressing portion 15*b* urging the control arm 10 by depressing the rocker arm 11, such that the roller 10*c* comes into contact with the swing cam surface 9*b*. Thus, the roller 10*c* of the control arm 10 can be constantly in contact with the swing cam surface 9*b* of the swing member 9 by a simple constitution. Also, a rolling contact of the roller 10*c* with respect to the motion of the swing cam surface 9*b* can be kept normal, thereby preventing the wearing of the swing cam surface 9*b* and the roller 10*c*.

Offset displacement of the eccentric pin 14*b* is preset so that the outer surface 14*b*' of the eccentric pin 14*b* protrudes outward from the outer surface 14*a*' of the rocker shaft 14 in the radial direction. This can increase the displacement of the control arm 11 without increasing the diameter of the rocker shaft 14, thereby increasing the adjustment range for the valve opening duration and amount of valve lift.

When the eccentric pin 14*b* protrudes outward, an inner peripheral surface of the bearing portion 11*c* supported with the rocker shaft 14 of the rocker arm 11 is formed with the clearance recess 11*f* which conforms with the amount of protrusion of the eccentric pin 14*b*. Thus, while the clearance recess 11*f* of the rocker arm 11 fits the protrusion of the eccentric pin 14*b*, the rocker arm 11 is displaced in the axial direction of the rocker shaft 14, so that the rocker arm 11 can be assembled with the rocker shaft 14 without any problem.

In the low operation range in which the opening duration of the valve 3 is short and the amount of valve lift is small, the eccentric pin 14*b* is positioned at point c2 so that the displacement of the contact point (e) relative to the rotation angle of the rocker shaft 14 is smaller than the displacement in the medium operation range in which the opening duration of the valve 3 and the amount of valve lift are medium. This, in the low engine speed range, can avoid abrupt variations in engine output due to slight variations in rotation angle of the rocker shaft 14, and can provide smooth operations, thereby avoiding jerky feeling.

In the high operation range in which the opening duration of the valve 3 is long and so forth, the eccentric pin 14*b* is positioned at (c1), so that the displacement of the contact point (e) relative to the opening angle of the rocker shaft 14 is preset smaller than the displacement in the medium operation range in which the opening duration of the valve is medium and so forth. This, in the high engine speed range, can reduce a torque required for rotating rocker shaft 14, and can provide smooth driving operations.

The control arm 10 is brought into sliding contact with the step 14*c* from the eccentric pin 14*b* of the rocker shaft 14, thereby positioning the control arm in the axial direction. The rocker arm 11 is brought into sliding contact with the axial end surface 10*f* of the control arm 10, thereby positioning the rocker arm in the axial direction. Therefore, positioning of the control arm 10 and the rocker arm 11 in the axial direction can be achieved without any dedicate parts.

In the description of the first embodiment, the come-off prevention member is a leaf spring. However, as shown in FIG. 4, the come-off prevention member of the invention may be a rod-shaped come-off prevention pin whose both ends are press-fitted through the outer ends of the bearing portion 10*d*.

In the description of the first embodiment, the control arm is included in the rocker arm. However, the control arm may be disposed externally to the rocker arm in the invention.

Figure 5:
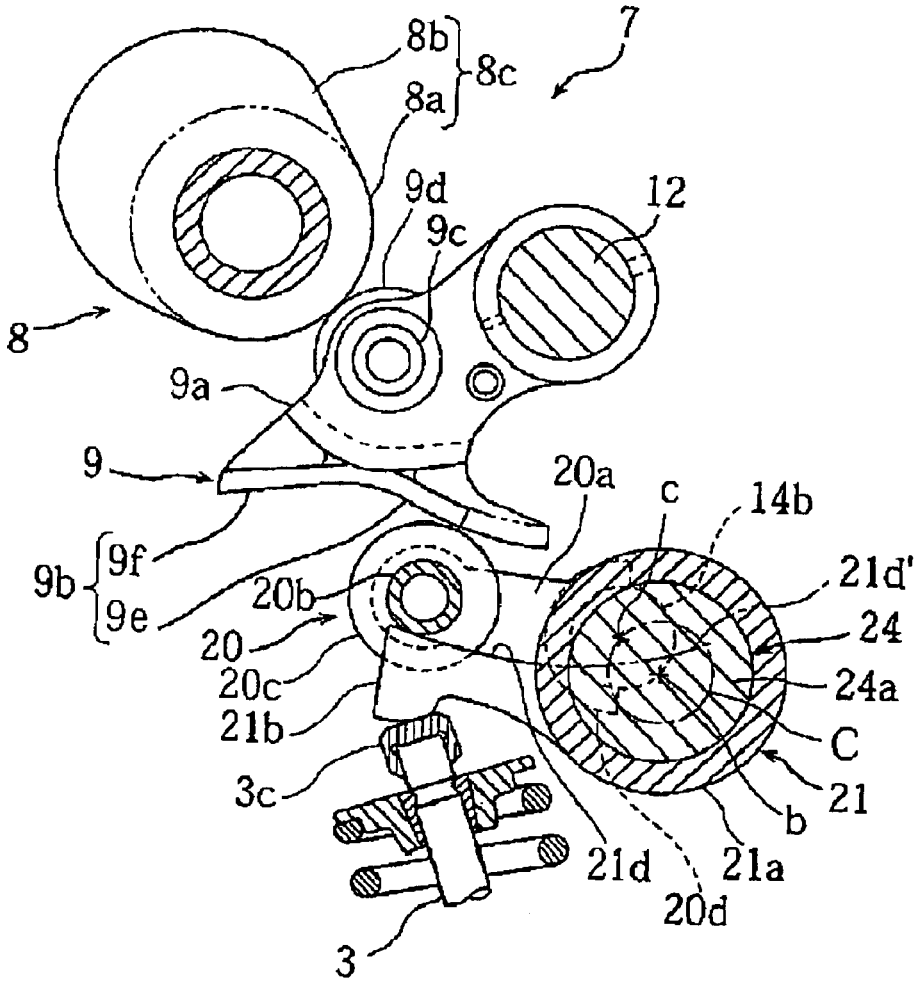
FIG. 5 is a sectional side view for describing a second embodiment of the invention.
Figure 6:
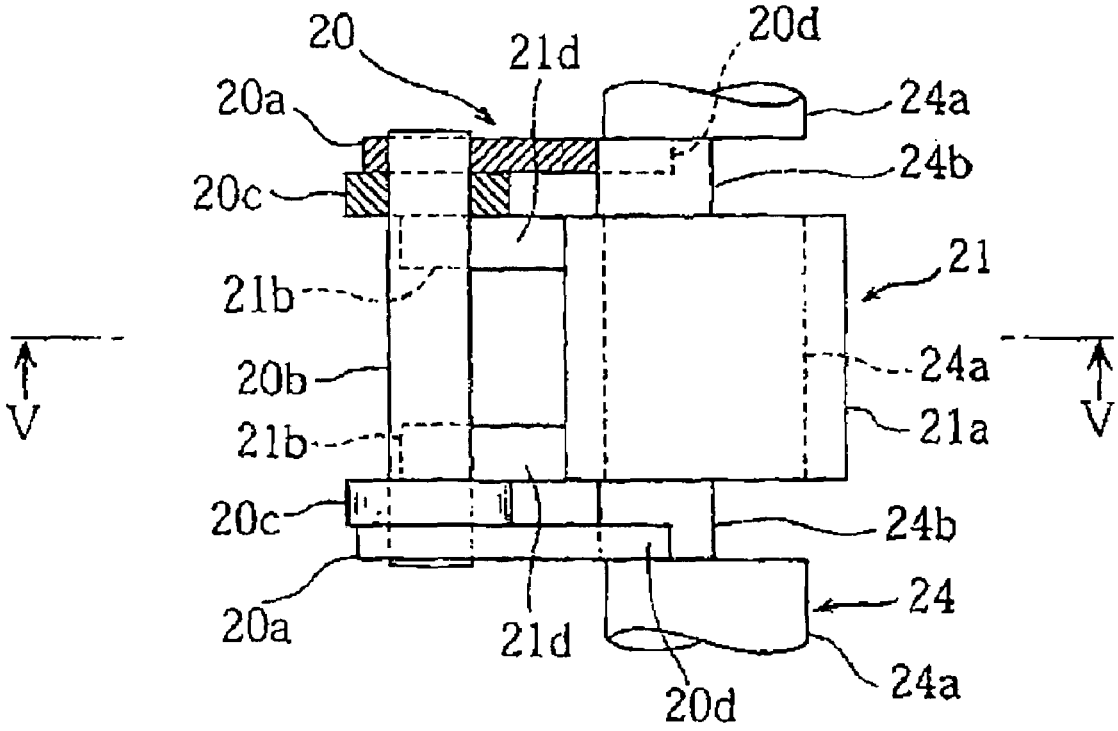
FIG. 6 is a schematic top plan view of the second embodiment.

For example, FIGS. 5 and 6 are for describing a second embodiment in which a control arm is disposed externally to a rocker arm. In these figures, the same reference numerals as in FIGS. 1 to 4 designate the same or corresponding parts.

A rocker arm 21 includes: a cylindrical bearing portion 21*a* supported with a large-diameter portion 24*a* of a rocker shaft 24; and left and right rocker arm portions 21*b*, 21*b* integrally extending forward from axially opposite ends of the bearing portion 21*a*. Bottom surfaces of the distal ends of the rocker arm portions 21*b* come into contact with the top ends of left and right intake valves 3, 3, respectively.

Rocker-side depressed surfaces 21*d* are formed on the topside of the left and right rocker arm portions 21*b*. The rocker-side depressed surfaces 21*d* are formed in an arcuate shape of a predetermined radius about an axial center of a swing shaft 12. An extension line 21*d*' of the rocker-side depressed surface 21*d* is so set as to pass in the vicinity of a center of swing (b) of the rocker arm 21, and more preferably, to pass inside a rotation locus C of an axial center (c) of an eccentric pin 24*b*.

The control arm 20 includes a pair of left and right arm portions 20*a*, 20*a*, a roller shaft 20*b* and proximal end portions 20*d* of the left and right arm portions 20*a*, 20*a*. The roller shaft 20*b* rigidly connects the distal ends of the left and right arm portions 20*a*, 20*a* together. The proximal end portions 20*d*, which are formed in a semi-circular, are coupled and supported with the eccentric pin 24*b* of the rocker shaft 24, and retained together with the eccentric pin by the leaf spring, using the same constitution as in the first embodiment.

The left and right arm portions 20*a*, 20*a* are positioned externally to their associated rocker arm portions 21*b*, 21*b* in the axial direction. Each arm portion and the associated rocker arm portion form a clearance between them to accommodate a roller 20*c*. The rollers 20*c*, 20*c* are supported with the roller shaft 20*b* for free rotation. The rollers 20*c* are in rotational contact with a swing cam surface 9*b* of the swing arm 9.

The roller shaft 20*b* is in sliding contact with the left and right rocker-side depressed surfaces 21*d*, 21*d* of the rocker arm 21. In other words, in this embodiment, the roller shaft 20*b* has a control-side depressing surface for depressing the rocker-side depressed surface 21*d*.

The second embodiment of the invention is constituted in a way such that: the arm portions 20*a* of the control arm 20 are placed externally to the rocker arm portions 21*b* of the rocker arm 21, the roller 20*c* is placed between the arm portion and the rocker arm portion, and the roller shaft 20*b* depresses the rocker-side depressed surface 21*d*. This enables the rocker-side depressed surface 21*d* to be formed such that an extension line 21*d*' thereof passes in the vicinity of the center of swing (b) of the rocker arm 21. This can enhance transfer efficiency of force from the control arm 20 to the rocker arm 21 as with the case in the first embodiment.

According to the embodiments described herein, as shown in FIG. 3, the control arm 10 is designed to transfer the motion of the swing cam surface 9*b* of the swing member 9 to the rocker-side depressed surface lid of the rocker arm 11. In this case, the rocker-side depressed surface 11*d* is formed in an arcuate shape about the center of swing (a) of the swing member 9, such that the rocker-side depressed surface 11*d* or its extension line 11*d*' passes in the vicinity of the center of swing (b) of the rocker arm 11. Thus, the force F applied from the swing member 9 to the control arm 10 can be efficiently transferred to the rocker arm 11 and therefore to the valve 3.

To be more specific, the force F transmitted from the control arm 10 to the rocker arm 11 is divided into a first component force (rotational force of the rocker arm) F1 perpendicular to the direction of a straight line Lo that connects a point (f) of application of the force F and the center of swing (b) of the rocker arm, and into a second component force F2 in the direction of the straight line Lo. In the embodiments described herein, since the rocker-side depressed surface 11*d* or its extension line lid' passes in the vicinity of the center of swing (b) of the rocker arm 11, the rocker-side depressed surface 11*d* generally agrees with the straight line Lo. This decreases the second component force F2 while increasing the first component force F1, which results in enhanced transfer efficiency of the force F from the control arm 10 to the rocker arm 11.

According to the illustrated embodiment of FIGS. 1–3, the control arm 10 is interposed between the left and right rocker arm portions 11*a*, 11*a* of the rocker arm 11, and the rocker-side depressed surface 11*d* is formed on the rocker coupling portion 11*b* for coupling the left and right rocker arm portions 11*a*, 11*a*. This facilitates placing the rocker-side depressed surface 11*d* or its extension line 11*d*' such that it passes in the vicinity of the center of swing (b) of the rocker arm 11, thereby achieving enhanced transmission efficiency of the force from the control arm 10 to the rocker arm 11.

According to the embodiments of FIGS. 5–6, the control arm 20 is provided with the roller 20*c* which comes into contact with the swing cam surface 9*b* such that the roller is located externally to the rocker arm portion 21*b* of the rocker arm 21, and the roller shaft 20*b* for supporting the roller 20*c* is designed to depress the rocker-side depressed surface 21*d* of the rocker arm portion 21*b*. This facilitates the rocker-side depressed surface 21*d* or its extension line 21*d*' being formed to pass in the vicinity of the center of swing (b) of the rocker arm 21, thereby achieving enhanced transfer efficiency of the force from the control arm 20 to the rocker arm 21.

According to the embodiment of FIGS. 1–3, the proximal end of the control arm portion 10*a* is rotatably coupled with the eccentric pin 14*b* provided on the midsection of the rocker shaft 14, and rotating the rocker shaft 14 allows displacing the contact point between the roller 10*c* and the swing cam surface 9*b* and the contact point between the control-side depressing surface 10*b* and the rocker-side depressed surface 11*d*. This allows the opening duration of the valve 3 and the amount of the valve lift to continuously change by using a very simple structure that can be actuated by solely rotating the rocker shaft 14.

To the illustrated embodiments, the rocker-side depressed surface 11*d* or its extension line 11*d*' passes inside the rotation locus C of the axial center (c) of the eccentric pin 14*b*, which is generated by rotating the rocker shaft 14. Thus, enhanced transmission efficiency of the force from the control arm 10 to the rocker arm 11 can be more certainly achieved.

According to the embodiment of FIGS. 1–3, offset displacement of the eccentric pin 14*b* is preset so that the outer surface 14*b*' of the eccentric pin 14*b* protrudes outward from the outer surface 14*a*' of the rocker shaft 14 in the radial direction. This can increase the displacement of the control arm 11 without increasing the diameter of the rocker shaft 14, thereby increasing the adjustment range for the valve opening duration and amount of the valve lift.

For the eccentric pin 14*b* protruding outward, an inner peripheral surface of the bearing portion 11*c* of the rocker arm 11, which is supported on the rocker shaft 14, is formed with the clearance recess 11*f* which conforms with the amount of protrusion of the eccentric pin 14*b*. Thus, while the clearance recess 11*f* fits the protrusion of the eccentric pin 14*b*, the rocker arm 11 is displaced in the axial direction of the rocker shaft 14, so that the rocker arm 11 can be assembled to the rocker shaft 14 without any problem.

According to the embodiments described above, the displacement of the contact point relative to the rotation angle of the rocker shaft 14 in a low operation range, in which the opening duration of the valve 3 is short and the amount of the valve lift is small, is preset smaller than the displacement of the contact point in a medium operation range in which the opening duration of the valve 3 and the amount of the valve lift are medium. This, in the low engine speed range, can avoid abrupt variations in engine output due to slight variations in rotation angle of the rocker shaft 14, and can provide smooth operations, thereby avoiding jerky feeling.

The displacement of the contact point in a high operation range, in which the opening duration of the valve 3 is long and so forth, is preset smaller than the displacement of the contact point in a medium operation range. This, in the high engine speed range, can reduce a torque required for rotating rocker shaft 14, and can provide smooth driving operations.

According to embodiment shown in FIG. 4, the semi-circular-shaped bearing portion 10*d* is formed at and integrally with the proximal end of the control arm portion a, and rotatably supported with the eccentric pin 14*b*, and the come-off prevention member is provided for preventing the bearing portion 10*d* and the eccentric pin 14*b* from separating from each other. This facilitates work for coupling the control arm 10 and the eccentric pin 14*b*.

To be more specific, in the case of multi-cylinder engine, adjustments for uniform valve opening duration and amount of the valve lift are needed for all cylinders. Therefore, several control arms 10 within the dimensional tolerance range are prepared for selecting a combination to uniform the valve opening duration and the amount of the valve lift. Assembly and removal of the control arm to be carried out for selecting the combination are required to be easy. The illustrated embodiments can meet such a requirement.

According to the embodiment of FIGS. 1–3, the come-off prevention member is a leaf spring 15 for holding the bearing portion 10*d* of the control arm portion 10*a* and the eccentric pin 14*b*. This further facilitates the assembly/removal of the control arm 10 to/from the rocker shaft 14.

Also, the leaf spring 15 has the depressing portion 15*b* integrally formed therewith and urging the control arm 10 by depressing the rocker arm 11 such that the roller 10*c* comes into contact with the swing cam surface 9*b*. Thus, the roller 10*c* of the control arm 10 can be constantly in contact with the swing cam surface 9*b* of the swing member 9 with a simple constitution. Therefore, a rolling contact of the roller 10*c* with respect to the motion of the swing cam surface 9*b* can be kept normal, thereby preventing the wearing of the swing cam surface 9*b* and the roller 10*c*.

According to the embodiments described above, the control arm 10 is brought into sliding contact with the step 14*c* from the eccentric pin 14*b* of the rocker shaft 14, thereby being positioned in the axial direction. Also, the rocker arm 11 is brought into sliding contact with the axial end surface 10*f* of the control arm 10, thereby being positioned in the axial direction. Therefore, positioning of the control arm 10 and the rocker arm 11 in the axial direction can be achieved without any dedicate parts.

According to the embodiments described above, the center of swing (a) of the swing member 9 is located at a point opposite to the valve shaft line L1 with respect to the straight line L2 parallel to the valve shaft line L1 and passing the axial center (b) of the rocker shaft 14. This gives advantage to the rocker-side depressed surface 11*d* or its extension line 11*d*' to pass in the vicinity of the center of rotation (b) of the rocker arm 11. More specifically, as an angle formed between the direction of the force F applied to the rocker arm 11 and the straight line Lo that connects the point (f) of application of the force F and the center of swing (b) of the rocker arm 11 is closer to the right angle, the transfer efficiency of the force increases. Since the center of swing (a) of the swing member 9 is located on the side opposite to the valve shaft line L1, the direction of the force F can be easily set perpendicular to the direction of the straight line Lo.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A valve train device for an engine is configured to pivot a rocker arm supported on a rocker arm support shaft to drive a valve which opens and closes a valve opening formed in a combustion chamber, the device comprising:

a valve drive device;

a swing member pivotally supported on a swing member support shaft and driven to pivot about the swing member support shaft by the valve drive device;

a control arm, which is disposed between a swing cam surface formed on the swing member and a rocker-side surface formed on the rocker arm, for transferring motion of the swing cam surface to the rocker-side surface; and a displacement mechanism for displacing a contact point between the control arm and the swing cam surface and a contact point between the control arm and the rocker-side surface;

wherein the rocker-side surface has an arcuate shape which arcs about a center of pivoting motion of the swing member and wherein the rocker-side surface or line extending from the rocker-side surface about said center of pivoting motion of the swing member passes substantially near a center of swing of the rocker arm.

2. The valve train device for an engine according to claim 1, wherein the rocker-side surface or the extension of the rocker-side surface lies substantially near a straight line that connects the center of pivoting motion of the rocker arm to the contact point between the control arm and the rocker side surface.

3. The valve train device for an engine according to claim 1, wherein the rocker-side surface at least partially forms a recess in the rocker arm.

4. The valve train device for an engine according to claim 1, wherein the extension of the rocker-side surface extends through the rocker arm support shaft.

5. The valve train device for an engine according to claim 1, wherein the rocker arm comprises left and right rocker arm portions that are supported by the rocker arm support shaft and are coupled together by a rocker coupling portion.

6. The valve train device for an engine according to claim 5, wherein the control arm comprises a control arm portion with a distal end that forms a control-side surface that contacts the rocker arm; and a contact portion provided at the distal end of the control arm portion that contacts the swing cam surface, the control arm being interposed between the left and right rocker arm portions, and the rocker-side surface being formed on the rocker coupling portion.

7. The valve train device for an engine according to claim 6, wherein the contact portion of the control arm, is a roller supported at the distal end of the control arm portion.

8. The valve train device for an engine according to claim 1, wherein the rocker arm has a rocker arm portion pivotally supported on the rocker arm support shaft and the control arm includes a roller that comes into contact with the swing cam surface, the roller being positioned externally, with respect to the longitudinal axis of the rocker arm support shaft, to the rocker arm.

9. The valve train device for an engine according to claim 8, comprising a roller shaft that supports the roller of the control arm, the roller shaft forming a control-side surface which comes into contact with the rocker-side surface formed on the rocker arm.

10. The valve train device for an engine according to claim 1, wherein the displacement mechanism comprises an eccentric pin that is positioned on the rocker support shaft.

11. The valve train device for an engine according to claim 10, wherein the eccentric pin is positioned on a midsection of the rocker support shaft, and a proximal end of the control arm is rotatably coupled to the eccentric pin, and rotating the rocker shaft allows displacing the contact point between the control arm and the swing cam surface and the contact point between the control arm and the rocker-side surface.

12. The valve train device for an engine according to claim 10, wherein the rocker-side surface or the extension of the rocker-side surface passes inside a circle defined by a rotation locus of an axial center of the eccentric pin, which is generated by rotating the rocker support shaft.

13. The valve train device for an engine according to claim 10, wherein the eccentric pin has a surface that protrudes outward from an outer surface of the rocker arm support shaft in a radial direction.

14. The valve train device for an engine according to claim 13, wherein an inner peripheral surface of a bearing portion of the rocker arm supported on the rocker arm support shaft includes a clearance recess that conforms to the protrusion of the eccentric pin.

15. The valve train device for an engine according to claim 10, wherein the displacement mechanism is configured such that displacement of the contact point between the control arm and the swing cam surface relative to the rotation angle of the rocker arm support shaft in a low or high operation range, in which the opening duration of the valve is short or long and the amount of the valve lift is small or large, is smaller than the displacement of the contact point between the control arm and the swing cam surface in a medium operation range in which the opening duration of the valve and the amount of the valve lift are between the low and high operation range.

16. The valve train device for an engine according to claim 10, wherein a coupling portion of the control arm portion with the eccentric pin includes a semi-circular-shaped bearing portion formed integrally with a proximal end of the control arm portion, and is rotatably supported with the eccentric pin.

17. The valve train device according to claim 16, further comprising a come-off prevention member that is configured to prevent the bearing portion and the eccentric pin from separating from each other.

18. The valve train device for an engine according to claim 17, wherein the come-off prevention member is a leaf spring configured to hold the bearing portion of the control arm portion and the eccentric pin, and the leaf spring has a depressing portion integrally formed therewith and urging the control arm by depressing the rocker arm such that the roller comes into contact with the swing cam surface.

19. The valve train device for an engine according to claim 10, wherein the valve train device is configured such that the control arm is brought into sliding contact with an axially facing step from the eccentric pin of the rocker arm support shaft and the rocker arm is brought into sliding contact with an axially facing end surface of the control arm.

20. The valve train device for an engine according to claim 1, wherein a valve shaft line extends through a longitudinal axis of the valve, a second line lies parallel to the valve shaft line and passes through an axial axis of the rocker arm support shaft and between a center of pivoting motion of the swing member and the valve shaft line.

21. The valve train device for an engine according to claim 1, wherein the valve drive device comprise a camshaft.

22. The valve train device for an engine according to claim 21, wherein the valve drive device comprise a camshaft for an intake valve.

* * * * *